US006435776B2

(12) United States Patent
Vickars et al.

(10) Patent No.: US 6,435,776 B2
(45) **Date of Patent: *Aug. 20, 2002**

(54) METHOD AND APPARATUS FOR FORMING PILES IN PLACE

(75) Inventors: Robert Alfred Vickars, Burnaby; Jeremiah Charles Tilney Vickars, New Westminster; Gary Matheus Toebosch, Surrey, all of (CA)

(73) Assignee: Vickars Development Co. Ltd., British Columbia (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/877,956

(22) Filed: Jun. 8, 2001

Related U.S. Application Data

(60) Division of application No. 09/000,722, filed on Dec. 30, 1997, now Pat. No. 6,264,402, which is a continuation-in-part of application No. 08/577,967, filed on Dec. 26, 1995, now Pat. No. 5,707,180.

(51) Int. Cl.[7] ..... E21B 10/64; E02D 5/38

(52) U.S. Cl. ..... 405/239; 405/237; 405/241; 52/169.13; 175/262

(58) Field of Search ..... 405/233, 239–248, 405/232, 237, 241, 249, 244, 251; 52/169.13, 169.9, 741.15, 742.14; 175/257, 262, 394

(56) References Cited

U.S. PATENT DOCUMENTS

| | | | | |
|---|---|---|---|---|
| 2,326,872 | A | 8/1943 | Marsden | 405/251 |
| 2,412,239 | A | 12/1946 | Weber | 405/236 |
| 2,926,500 | A | 3/1960 | Hoppe | 405/253 |
| 3,354,657 | A | 11/1967 | Turzillo | 405/244 |
| 3,391,544 | A | 7/1968 | Daczko | 405/241 |
| 3,512,366 | A | 5/1970 | Turzillo | 405/241 |
| 3,677,018 | A | 7/1972 | Van Weele | 405/232 |
| 3,841,032 | A | 10/1974 | Grannis, III | 52/27 |
| 3,962,879 | A | 6/1976 | Turzillo | 405/236 |
| 4,239,419 | A | 12/1980 | Gillen, Jr. | 405/232 |
| 4,334,392 | A | 6/1982 | Dziedzic | 52/157 |
| 4,405,262 | A | 9/1983 | Nagashima | 405/221 |
| 4,467,575 | A | 8/1984 | Dziedzic | 52/157 |
| 4,499,698 | A | 2/1985 | Hoyt et al. | 52/157 |
| 4,561,231 | A | 12/1985 | Hoyt et al. | 52/297 |
| RE32,076 | E | 2/1986 | Dziedzic | 405/303 |
| 4,623,025 | A | 11/1986 | Verstraeten | 175/21 |
| 4,678,373 | A | 7/1987 | Langebach | 405/230 |
| 4,707,964 | A | 11/1987 | Hoyt et al. | 52/742 |
| 4,708,530 | A | 11/1987 | Faber | 405/252 |
| 4,981,000 | A | 1/1991 | Hamilton et al. | 52/157 |
| 4,996,806 | A | 3/1991 | Platz | 52/157 |
| 5,011,336 | A | 4/1991 | Hamilton et al. | 405/230 |
| 5,066,168 | A | 11/1991 | Holdeman | 405/249 |
| 5,113,626 | A | 5/1992 | Seider et al. | 52/157 |
| 5,120,163 | A | 6/1992 | Holdeman et al. | 405/230 |
| 5,139,368 | A | 8/1992 | Hamilton et al. | 415/230 |
| 5,171,107 | A | 12/1992 | Hamilton et al. | 405/230 |
| 5,213,448 | A | 5/1993 | Seider et al. | 405/230 |
| 5,286,142 | A | 2/1994 | Hoyt et al. | 405/244 |
| 5,320,452 | A | 6/1994 | Kunito | 405/233 |
| 5,573,348 | A | 11/1996 | Morgan | 405/52 |
| 5,575,593 | A | 11/1996 | Raaf | 405/233 X |
| 5,683,207 | A | 11/1997 | Mauer | 405/244 |
| 5,791,820 | A * | 8/1998 | Rempel | 405/232 |
| 5,833,399 | A | 11/1998 | Bullivant | 405/233 |

FOREIGN PATENT DOCUMENTS

| | | |
|---|---|---|
| CH | 653724 | 1/1986 |
| DE | 3501439 | 10/1985 |
| WO | 95/18892 | 7/1995 |

* cited by examiner

*Primary Examiner*—Robert E. Pezzuto
*Assistant Examiner*—Tara L. Mayo
(74) *Attorney, Agent, or Firm*—Oyen Wiggs Green & Mutala

(57) ABSTRACT

A screw pier has an elongated shaft with a screw adjacent one end thereof. Soil displacing members are disposed on the shaft. The soil displacing members may be drawn through soil by turning the screw. A soil displacing member closer to the screw may be smaller than one or more soil displacing members farther from the screw. A driving tool may be provided for turning the screw.

18 Claims, 15 Drawing Sheets

METHOD AND APPARATUS FOR FORMING PILES IN PLACE

CROSS-REFERENCE TO RELATED APPLICATIONS

This is a division of U.S. application Ser. No. 09/000,722, filed Dec. 30, 1997, now U.S. Pat. No. 6,264,402, which is a continuation-in-part of U.S. application Ser. No. 08/577,977, filed Dec. 26, 1995, now U.S. Pat. No. 5,707,180.

FIELD OF THE INVENTION

This invention relates to a method for making piles and to apparatus for practising the method of the invention. A preferred embodiment of the invention provides a method and apparatus for making piles to support the foundation of a structure, such as a building.

BACKGROUND OF THE INVENTION

Piles are used to support structures, such as buildings, when the soil underlying the structure is too weak to support the structure. There are many techniques that may be used to place a pile. One technique is to cast the pile in place. In this technique, a hole is excavated in the place where the pile is needed and the hole is filled with cement. A problem with this technique is that in weak soils the hole tends to collapse. Therefore, expensive shoring is required. If the hole is more than about 4 to 5 feet deep then safety regulations typically require expensive shoring and other safety precautions to prevent workers from being trapped in the hole.

Turzillo, U.S. Pat. No. 3,962,879 is a modification of this technique. In the Turzillo system a helical auger is used to drill a cylindrical cavity in the earth. The upper end of the auger is held fixed while the auger is rotated about its axis to remove all of the earth from the cylindrical cavity. After the earth has been removed fluid cement water is pumped through the shaft of the auger until the hole is filled with cement. The auger is left in place. Turzillo, U.S. Pat. No. 3,354,657 shows a similar system.

Langenbach Jr., U.S. Pat. No. 4,678,373 discloses a method for supporting a structure in which a piling bearing a footing structure is driven down into the ground by pressing from above with a large hydraulic ram anchored to the structure. The void cleared by the footing structure may optionally be filled by pumping concrete into the void through a channel inside the pile. The ram used to insert the Langenbach Jr. piling is large, heavy and expensive.

Another approach to placing piles is to insert a hollow form in the ground with the piles desired and then to fill the hollow form with fluid cement. Hollow forms may be driven into the ground by impact or screwed into the ground. This approach is cumbersome because the hollow forms are unwieldy and expensive. Examples of this approach are described in U.S. Pat. Nos. 2,326,872 and 2,926,500.

Helical pier systems, such as the CHANCE™ helical pier system available from the A.B. Chance Company of Centralia Mo. U.S.A., provide an attractive alternative to the systems described above. As described in more detail below, the CHANCE helical pier system includes one or more helical screws mounted at the end of a shaft. The helical screw comprises a section of metal plate having its inner edge welded to the shaft. The area around the inner edge is the root region of the screw. The plate is bent so that its outer edge generally follows a helix. The shaft is turned to draw the helical screw downwardly into a body of soil. The screw is screwed downwardly until the screw is seated in a region of soil sufficiently strong to support the weight which will be placed on the pier.

Brackets may be mounted on the upper end of the pier to support the foundation of a building. Helical pier systems have the advantages that they are relatively inexpensive to use and are relatively easy to install in tight quarters. Helical pier systems have two primary disadvantages. Firstly, they rely upon the surrounding soil to support the shaft and to prevent the shaft from bending. In situation where the surrounding soil is very weak or the pier is required to support very large loads the surrounding soil cannot provide the necessary support. Consequently, helical piers can bend in such situations. A second disadvantage of helical piers is that the metal components of the piers are in direct contact with the surrounding soil. Consequently, if the shaft passes through regions in the soil which are highly chemically active then the shaft may be eroded, thereby weakening the pier. A third disadvantage of helical piers exists in piers which comprise large diameter helices which bear large loads. Such helices can buckle and cause the pier to fail. Because their load bearing capacity is limited, helical pier systems have not been able to replace more conventional piles in many applications.

There is a need for a relatively inexpensive method for forming piles without the use of heavy expensive equipment which overcomes at least some of the above-noted disadvantages of helical piers.

SUMMARY OF THE INVENTION

This invention provides methods for forming piles which use a screw to pull a soil displacing member through soil. One aspect of the invention provides a method comprising the steps of: providing a screw pier comprising a shaft having a screw proximate a first end thereof and a first soil displacing member projecting radially outwardly from the shaft at a location spaced toward a second end of the shaft from the screw; placing the screw in soil and turning the shaft to draw the screw into the soil thereby causing the screw to pull the first soil displacing member through the soil, thereby clearing soil from a cylindrical region surrounding the shaft; either during or after the step (b) filling the cylindrical region with a fluid grout; and, allowing the fluid grout to solidify, thereby encasing the shaft.

Preferably the step of filling the cylindrical region with fluid grout comprises providing a bath of fluid grout around the shaft at a point where the shaft enters the soil and allowing fluid grout from the bath of fluid grout to flow into the cylindrical region as the screw is turned. A preferred embodiment comprises encasing at least a root portion of the screw in solidified grout. This protects the root portion of the screw from corrosive soils and reinforces the screw. In the preferred embodiment the method includes the steps of removing soil from a volume surrounding at least a root portion of the screw by holding the shaft against longitudinal motion, turning the screw in a first sense and forcing a fluid grout under pressure into the volume; and, allowing the grout in the volume to harden, thereby encasing surfaces of the screw in a protective layer of solidified grout. Preferably the fluid grout is forced under pressure into the volume while the screw is rotating. Most preferably the fluid grout is forced under pressure into the volume by forcing the fluid grout under pressure through a longitudinal channel within the shaft and directing the grout into the volume through apertures in a wall of the shaft.

Another preferred embodiment of the invention provides a method adapted to create a stepped pile. In this method, the screw pier comprises a plurality of additional soil displacing members having diameters larger than a diameter of the first soil displacing member, the additional soil displacing members at spaced apart locations on the portion of the shaft between the second end and the first soil displacing member. The additional soil displacing members toward the second end have diameters larger than diameters of the additional soil displacing members toward the first soil displacing member. The method includes drawing the additional soil displacing members through the soil to stepwise increase a diameter of the cylindrical region.

Another aspect of the invention provides a method for forming a pile. The method comprises the steps of: providing a screw pier comprising a shaft having a screw at one end thereof; placing the screw in the soil and turning the shaft to draw the screw into the soil; when the screw has reached a desired point, removing soil from a volume surrounding the screw by holding the shaft against longitudinal motion and turning the screw; and, forcing a fluid grout under pressure into the volume and allowing the grout in the volume to harden thereby encasing surfaces of the screw in a protective layer of solidified grout.

Yet another aspect of the invention provides a screw pier for making a grout encased stepped pile. The pier comprises an elongated shaft having first and second ends; a screw adjacent the first end of the shaft; a plurality of soil displacing members at spaced apart locations along the shaft, a first one of the soil displacing members having a diameter smaller than a diameter of the screw located near the screw, other ones of the soil displacing members having diameters larger than the first one of the soil displacing members, the soil displacing members nearer to the second end of the shaft having larger diameters than the soil displacing members farther from the second end of the shaft. In a preferred embodiment, the soil displacing members comprise flanges projecting radially from the shaft. The soil displacing members may comprise generally planar disks mounted on and oriented generally perpendicularly to the shaft.

A further aspect of the invention provides a screw pier for making a grout encased pile. The screw pier comprises: a lead section comprising a screw, a head and a soil displacement member between the screw and the head; an elongated shaft having a first end coupled to the lead section head; an elongated drive tool having a socket in driving engagement with the lead section head, the elongated shaft extending through a central bore in the drive tool; and a fastener at a second end of the elongated shaft, the fastener holding the drive tool socket engaged with the lead section head. After placement of the screw pier the drive tool may be removed and re-used. In a preferred embodiment, the drive tool comprises two or more sections connected by one or more joints and each joint comprises a head end of one drive tool section received in a socket on one end of another drive tool section. the socket is movable longitudinally relative to the head end between first and second positions. When the socket is in its first position, an edge of the socket projects past an abutment on the head end to provide a recess facing the screw. The recess is capable of receiving tab portions of sectors of a soil displacing member. When the socket is in its second position, the edge of the socket is retracted, thereby releasing the tab portions of the sectors.

The invention also provides a drive tool for installing a grout encased screw pier. The drive tool comprises an elongated shaft penetrated by a central bore. The shaft comprises two or more sections connected by one or more joints. The drive tool has a socket for drivingly coupling to a screw pier lead section at one end of the shaft. Each of the joints comprises a head end of one shaft section slidably received in a socket on one end of another shaft section. The socket is movable longitudinally relative to the head end between first and second positions. When the socket is in its first position, an edge of the socket projects past an abutment on the head end to define a recess facing toward the first end of the shaft. When the socket is in its second position, the edge of the socket does not project past the abutment.

BRIEF DESCRIPTION OF THE DRAWINGS

In drawings which illustrate preferred embodiments of the invention, but which should not be construed as restricting the spirit or scope of the invention in any way.

DETAILED DESCRIPTION OF PREFERRED EMBODIMENTS OF THE INVENTION

Prior Art

Figure 1:
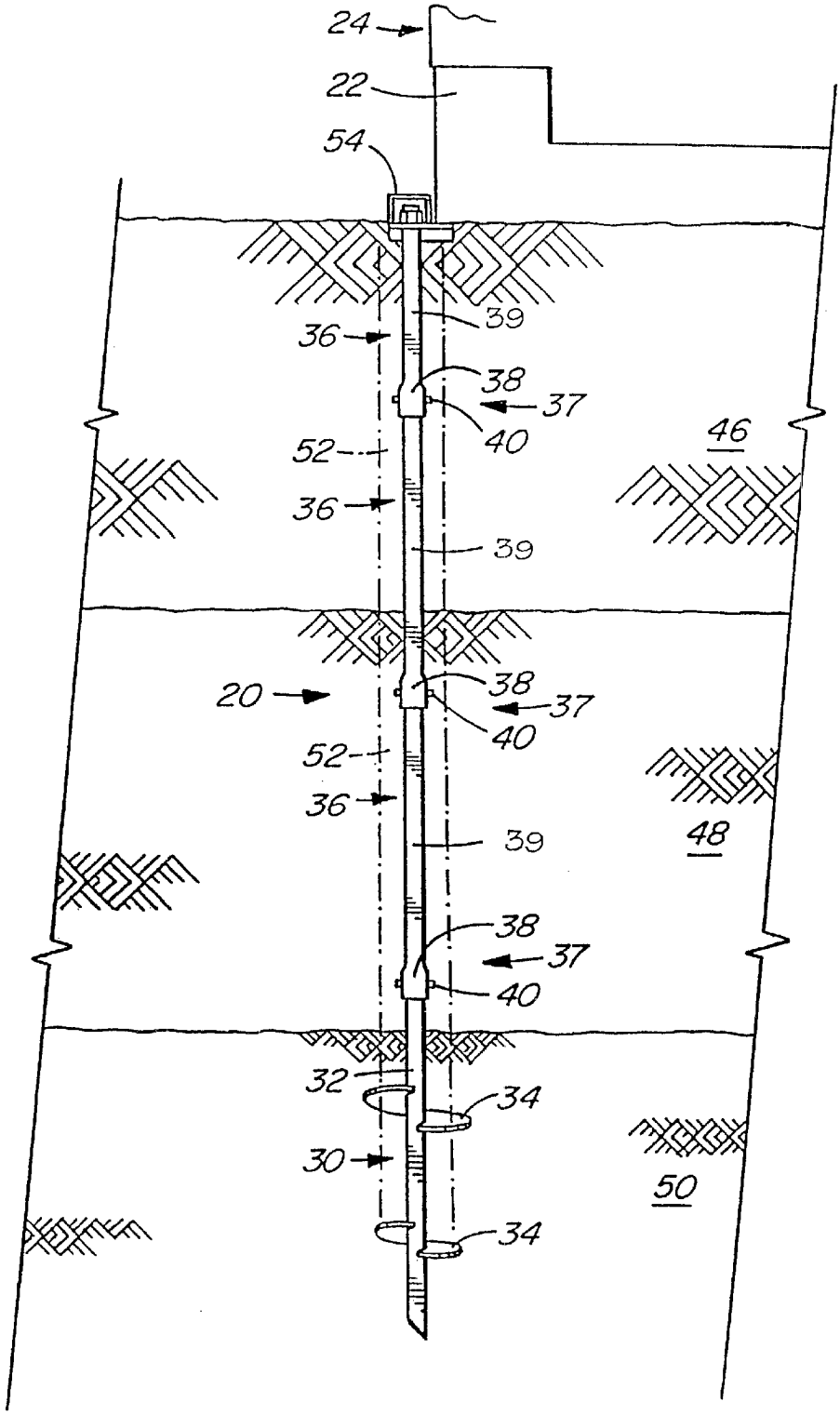
FIG. 1 PRIOR ART
FIG. 1 is an elevational view a prior art helical pier installed in a body of soil and supporting a building foundation.

FIG. 1 shows a prior art helical pier 20 supporting the foundation 22 of a building 24. Helical pier 20 has a lead section 30 which comprises a shaft 32 and a screw 34 mounted to shaft 32. Usually shaft 32 comprises a number of extension sections 36 which are coupled together at joints 37. Each extension section 36 comprises a shaft section 39 and a socket 38. Shaft sections 39 are typically square in section but may, of course, have other shapes. Sockets 38 comprise a square recess which fits over the top end of lead section 30 or the top end of the shaft section 39 of a previous one of extension sections 36. Bolts 40 are then used to secure extension sections 36 together. Lead sections are typically available in lengths in the range of 3 feet to 10 feet. Lead section 30 shown in FIG. 1 has a helical screw 34 comprising two helical segments attached to it. Screw 34 may comprise one or more helical segments. Additionally, some of extension sections 36 may also be equipped with screws 34.

Helical pier 20 is installed in the body of soil underlying foundation 22 by screwing lead section 30 into the earth adjacent foundation 22 and continuing to turn lead section 30 so that helical screw 34 draws lead section 30 downwardly. As lead section 30 is drawn downwardly extension sections 36 are added as needed. The installation is complete when helical screw 34 has been screwed down into a layer of soil capable of supporting the weight which will be placed on pier 20. In the example of FIG. 1, helical screw 34 has been screwed down through two weaker layers of soil 46 and 48 and into a layer 50.

A bracket 54 at the top of helical pier 20 supports foundation 22. Bracket 54 may be equipped with lifting means, as described, for example, in U.S. Pat. Nos. 5,120,163; 5,011,336; 5,139,368; 5,171,107 or 5,213,448 for adjusting the force on the underside of foundation 22.

A problem with the pier shown in FIG. 1 is that the pier can bend, and may even buckle, if the soil in regions 46 and/or 48 is not sufficiently strong to support shaft 32 against lateral motion. This tendency is exacerbated because sockets 38 are somewhat larger in diameter than shaft sections 39. Consequently, as sockets 38 are pulled down through the soil they disturb and further weaken a small cylindrical volume 52 of soil immediately surrounding shaft 32. Furthermore, there is generally some clearance between the side faces of shaft sections 39 and the walls of the indentations in sockets 38. Shaft 32 is therefore freely able to bend slightly at each of joints 37. It can be readily appreciated that when shaft 32 is in compression, the forces tending to push shaft 32 laterally are increased as shaft 32 becomes bent.

A second problem with the pier shown in FIG. 1 is that it is prone to corrosion. Generally pier 20 will be installed so that screw 34 is in a layer of soil 50 which will not corrode screw 34. In many cases, however, shaft 32 passes through other layers of soil which are more chemically active. In the example shown in FIG. 1, shaft 32 is in direct contact with the soil of layer 48 which may be highly corrosive. In the example shown in FIG. 1, even if screw 34 is imbedded in the layer of soil 50 which is chemically inert, the integrity of the entire pier 20 may be reduced if layer of soil 48 is highly chemically active and erodes those portions of shaft 32 which pass through layer of soil 48.

As an example of the problems which can occur in the use of prior art helical piers, several CHANCE™ SS150-1½" square shaft compression anchor were placed in alluvial soils in Delta, British Columbia, Canada. The shafts were then loaded. It was found that the shafts of the piers failed by buckling when the applied loads were in the range of about 25,000 lbs. to about 35,000 lbs. To provide a desired 2 to 1 safety factor it was necessary to limit the loading on each such pier to no more than approximately 15,000 lbs per pier. This increased the number of piers needed to support the structure in question.

This Invention

Figure 2:
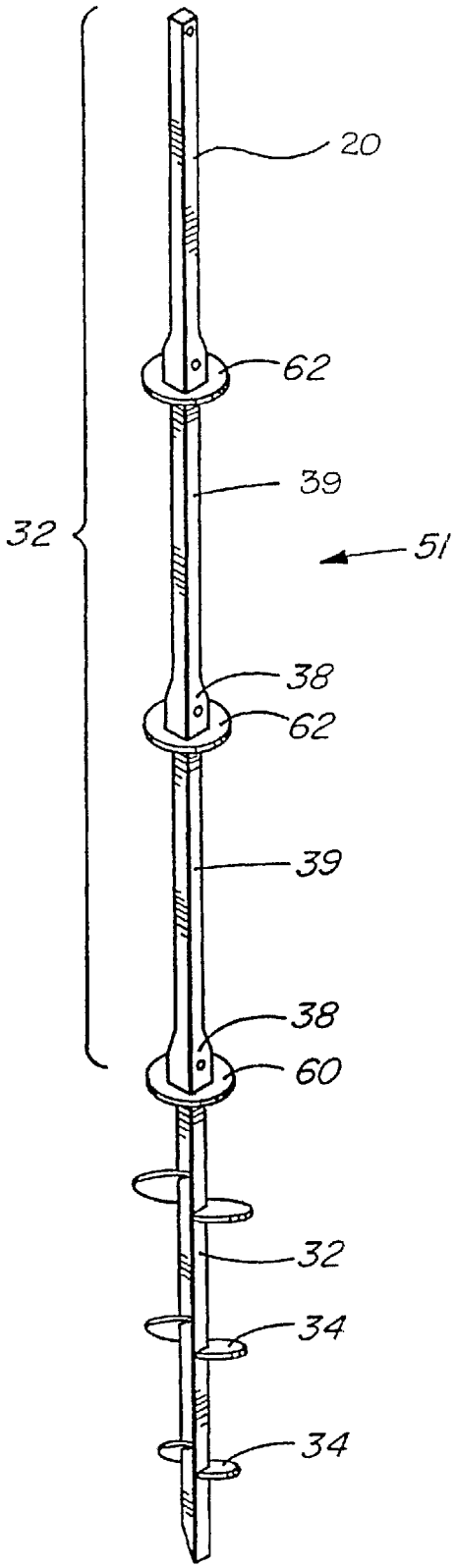
FIG. 2 is a side elevational view of apparatus for practising this invention.
Figure 4A:
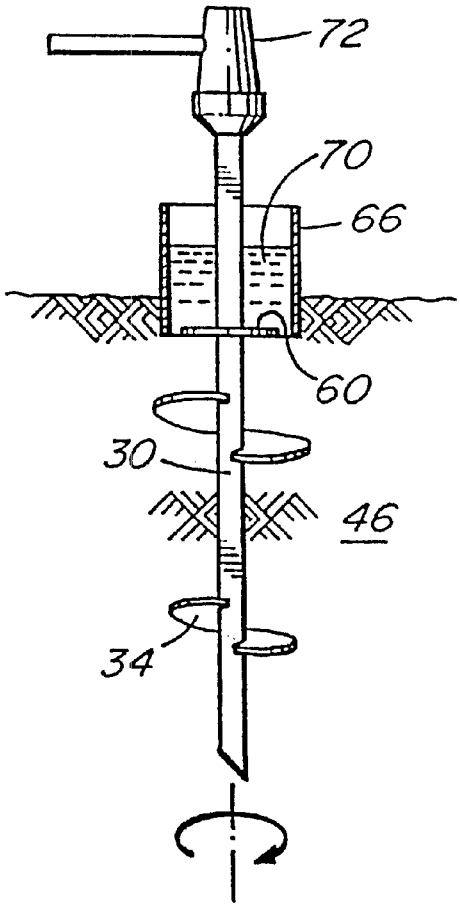
FIGS. 4A, 4B, 4C and 4D are schematic views of steps in practising the method of the invention.
Figure 4B:
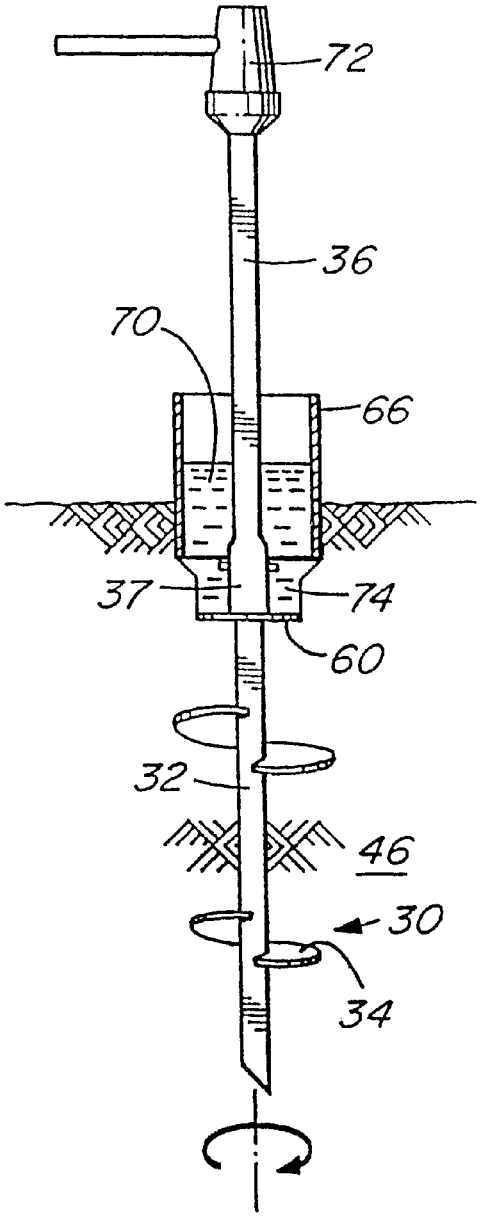
Figure 4C:
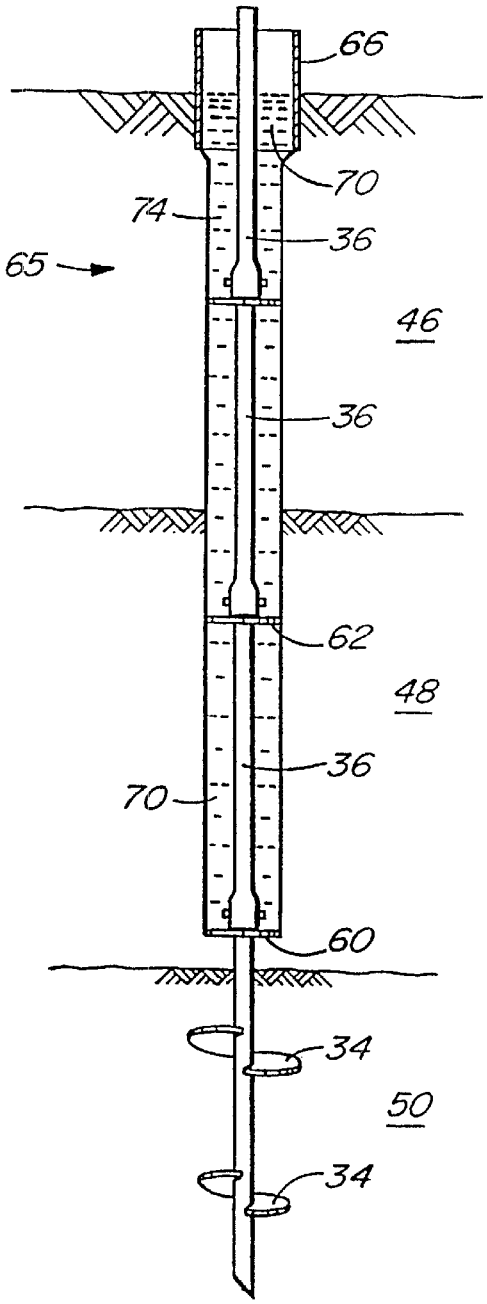
Figure 4D:
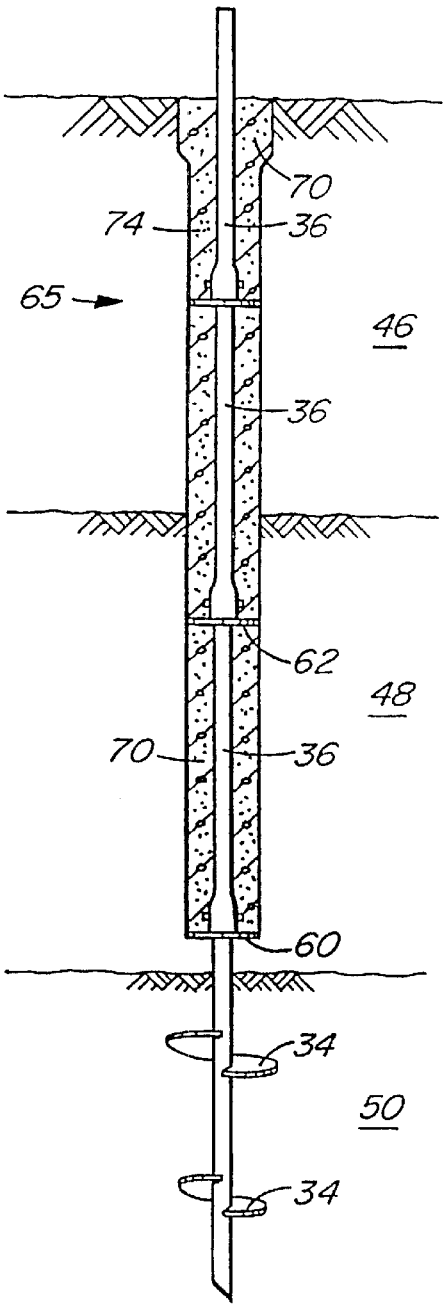

FIG. 2 shows apparatus 51 for practising the method of the invention to make a pile 65 (see FIGS. 4C and 4D). Pile 65 may be used to support a structure, which, for clarity, is not shown. Apparatus 51 comprises a helical pier 20, which is preferably a helical pier of the general type described above as shown in FIG. 1 and available from the A.B. Chance Company of Centralia Mo. Other types of helical pier could also be used, as will be readily apparent to those skilled in the art, after reading this specification. Helical pier 20 is modified for practising the invention by the addition of a soil displacing member which preferably comprises a disk 60 on shaft 32, spaced above screw 34. Disk 60 projects in flange like fashion in a plane generally perpendicular to shaft 32. One or more additional soil displacing members which are preferably additional disks 62 are spaced apart along shaft 32 above disk 60.

Soil displacing members for use with the invention may have various forms without departing from the invention. For example, instead of a disk 60 the soil displacing member may comprise a section of shaft 32 having an enlarged diameter. For example, as sockets 38 are manufactured, a portion of the material being used to form the socket may be flared outwardly in a flange-like fashion. The outwardly flared material can function as a soil displacement member without the necessity of separate parts. In some denser soils, the sockets 38 on prior art helical piers, as described above, might be large enough for use in practising the methods of the invention on a limited scale, although a larger diameter soil displacing member is generally preferred. Generally the diameter of the soil displacing member should be at least about twice the diameter of shaft 32. Soil displacing members should be sufficiently rigid that they will not be unduly deformed by the forces acting on them during installation of a pile, as described below.

Disk 60 may be rigidly held in place on shaft 32 but may also be slidably mounted on shaft 32. Where disk 60 is sidably mounted on shaft 32 it is blocked from moving very far upwardly along shaft 32 by a projection formed by, for example, the lowermost one of sockets 38. Preferably the apparatus includes one or more additional disks 62. Disks 62 are not necessarily all the same size and may be larger or smaller than disk 60 as is discussed in more detail below.

The preferred dimensions of disks 60, 62 and screw 34 depend upon the weight to be borne by pile, the properties of the soil in which pile 65 will be placed and the engineering requirements for pile 65. For example, in general: if the soil is very soft then larger disks may be used; if the soil is highly chemically active then larger disks may also be used (to provide a thicker layer of grout to protect the metal portions of the apparatus as described below); and if the soil is harder then smaller disks may be used. Disks 62 are spaced apart from disk 60 along shaft 32.

All of disks 60 and 62 are typically smaller than screw 34. For example, screw 34 is typically in the range of 6 inches to 14 inches in diameter. Shaft sections 39 are typically on the order of 1½" to 2" in thickness and disks 60, 62 are typically in the range of 4 inches to 16 inches in diameter. The preferred size for disks 60 depends upon the weight that will be borne by the pile, the relative softness or hardness of the soil where pile 65 will be placed and on the diameter of screw 34.

Figure 3:
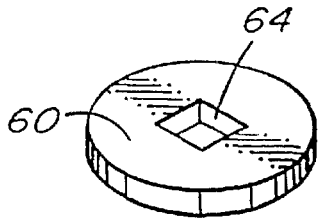
FIG. 3 is a top plan view of a plate for use with the invention.

A disk suitable for use as disk 60, 62 is shown in FIG. 3. Disk 60 may, for example, comprise a circular piece of steel plate thick enough to withstand significant bending forces as it is used and most typically approximately ¼ inch to ⅜ inches in thickness with a hole 64 at its centre. Preferably disks 60, 62 are galvanized although this is not necessary. Hole 64 is preferably shaped to conform with the cross sectional shape of shaft 32 so that disk 60 can be slid onto shaft sections 39. Hole 64 is smaller than joints 37. As will be readily appreciated from a full reading of this disclosure, disks 60 and 62 do not necessarily need to be flat but may be curved and/or dished. Flat disks 60, 62 are generally preferred because they can work well and are less expensive to make than curved or dished disks.

Disk 60 displaces soil from a cylindrical region 74 around shaft 32 as it is pulled downwardly through the soil by screw 34. As described above, disk 60 may be replaced with an alternative soil displacing member which will clear cylindrical region 74 of soil as it is pulled through the soil by screw 34. It will readily be apparent to those skilled in the art that various members of different shapes or configurations may be attached to shaft 32 in place of disk 60 to displace soil from a generally cylindrical volume surrounding shaft 32 and that such members can therefore function as soil displacing members within the broad scope of this invention.

The method provided by the invention for making and placing a pile 65 is illustrated in FIGS. 4A through 4D. First, shown in FIG. 4A the lead section 30 of a helical pier is turned with a suitable tool 72 so that screw 34 is screwed into the soil at the point where a pile is desired. After screw 34 has screwed into the soil, disk 60 is slipped onto the shaft portion of lead section 30 and a tubular casing 66 is placed around the projecting shaft of lead section 30. The lower edge of tubular casing 66 is embedded in the surface of soil 46. Tubular casing 66 is then partially filled with fluid grout 70 and the level of grout 70 is marked.

Optionally, casing 66 may be placed first at the location where it is desired to place pile 65 and lead section 30 may be introduced downwardly through casing 66 and screwed into the soil inside casing 66 either before or after grout 70 has been introduced into casing 66. Where lead section 30 is started after grout 70 has been placed in casing 66 then grout 70 may lubricate screw 34 and thereby reduce the torque needed to start screw 34 into the soil beneath casing 66.

Tubular casing 66 typically and conveniently comprises a round cardboard form approximately 24" high and approximately 18" in diameter. However, casing 66 may be any form capable of holding a bath of fluid grout 70 and large enough to pass disks 62. It is not necessary that casing 66 be round although it is convenient and attractive to make casing 66 round.

In some cases, for example where a pile is being installed through a hole in a cement foundation, it may be unnecessary to provide a separate casing 66 because a suitable bath of fluid grout 70 may be formed and kept in place by pouring fluid grout 70 directly into the hole or an excavation in the soil immediately under the hole.

Next, as shown in FIG. 4B, an extension section 36 is attached to lead section 30 and a driving tool is attached to the top of extension section 36 to continue turning shaft 32 and screw 34. Shaft 32 slips through the centre of disk 60 until first joint 37 hits disk 60. Subsequently, screw 34 pulls disk 60 down through soil 46. Disk 60 compresses and displaces the soil below its lower surface as disk 60 is pulled downwardly. As this happens, grout flows downwardly under the action of gravity from tubular casing 66 into a cylindrical region 74 which disk 60 has cleared of soil.

As disk 60 is pulled downwardly, grout 70 flows into cylindrical region 74 and the level of grout 70 in tubular casing 66 goes down. Tubular casing 66 is periodically refilled with grout. Preferably the amount of grout introduced into tubular casing 66 is measured so that the total amount of grout which flows into cylindrical region 74 may be readily calculated. This information may be needed obtain an engineer's approval of pile 65.

As shown in FIG. 4C, additional disks 62 on additional extension sections 36 are added as screw 34 pulls disks 60 and 62 downwardly through soil 46 until, ultimately, screw 34 is embedded in a stable layer 50 of soil. Disks 62 maintain shaft 32 centered in cylindrical region 74 and may also help to keep soil from collapsing inwardly into cylindrical region 74. In some applications only one or two disks 60, 62 may be necessary. Tubular casing 66 is then removed and grout 70 is allowed to harden. Tubular casing 66 may also be left in place.

The end result, as shown in FIG. 4D, is that extension sections 36 are encased in a hardened cylindrical column of grout 70. Hardened grout 70 prevents extension section 36 from moving relative to one another and reinforces the portions of shaft 32 above disk 60. Grout 70 also protects shaft 32 from corrosion. The diameter of the column of grout 70 surrounding shaft 32 depends upon the diameter of the soil displacement means (i.e. disk 60 in the embodiment shown in FIG. 4) being used.

Figure 10:
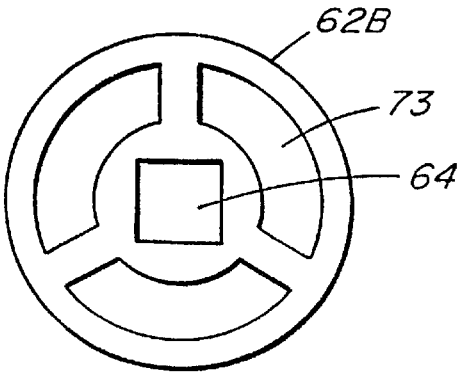
FIG. 10 is a top plan view of a fenestrated disk for use with the invention.

As disk 60 is drawn down through soil 46 disk 60 forces soil 46 outwardly and downwardly so that the soil surrounding cylindrical region 74 is somewhat compressed. This helps to retain grout 70 in cylindrical region 74 and also helps to make pile 65 resistant to lateral motion in soil 46 after grout 70 has solidified. The hydrostatic pressure of grout 70 in cylindrical region 74 also helps to keep soil from collapsing inwardly into cylindrical region 74 before grout 70 hardens.

Where disks 62 are solid, disks 62 may, in some soils, seal against the walls of cylindrical region 74 and isolate portions of cylindrical region 74 between disks 62. If this happened then the hydrostatic pressure of grout 70 in one or more of the isolated portions could be reduced if grout 70 leaked out of that portion into the surrounding soil. This could tend to allow the surrounding soil to collapse into cylindrical region 74. As shown in FIG. 10, disks 62 may be of a type 62B provided with fenestrations 73 so that the column of grout 70 in cylindrical region 74 is not interrupted by disks 62. This allows the full hydrostatic head of fluid grout 70 in cylindrical region 74 to press outwardly against the soil adjacent cylindrical region 74.

After grout 70 hardens, the hardened cylindrical column of grout 70 has a diameter similar to the diameter of disk 60, which is significantly larger than the diameter of shaft 32. It therefore takes a larger lateral force to displace pile 65 in soil of a given consistency than would be needed to displace the prior art helical pier 20 shown in FIG. 1. Therefore, pile 65 should have a significantly increased capacity for bearing compressive loads than a prior art helical pier 20 with a similarly sized shaft 32 and screw 34.

Grout 70 is preferably an expandable grout such as the MICROSIL™0 anchor grout, available from Ocean Construction Supplies Ltd. of Vancouver British Columbia Canada. This grout has the advantages that it tends to plug small holes and rapidly acquires a high compressive strength during hardening. Another property of this grout is that it resists mixing with water. Preferably grout 70 is fiber reinforced. For example, it has been found that the MICROSIL grout referred to above can usefully be reinforced by mixing it with fibrillated polypropylene fiber, such as the PROMESH™ fibers available from Canada Concrete Inc. of Kitchener, Ontario, Canada according to the fiber manufacturer's instructions. Typically approximately 1.5 pounds of fibers are introduced per cubic yard of grout 70 although this amount may vary. Other soil specific additives may be mixed with the grout as is known to those skilled in this art.

This invention could be practised in its broadest sense by using for grout 70 any suitable flowable material, such as, for example, cement or concrete, which will firmly set around shaft 32 after it is introduced into cylindrical region 74. Preferably, after it sets, grout 70 seals materials which are embedded in it from contact with any corrosive fluids which may be present in the surrounding soil.

Because shaft 32 is placed in tension as screw 34 pulls disks 60, 62 downwardly through soil 46, it is desirable to compress shaft 32 before grout 70 hardens. After each pile 65 has been placed, and before grout 70 hardens, the projecting end of shaft 32 atop pile 65 is hammered with a heavy hammer, for example, a 16–25 pound sledge. The amount that pile 65 will collapse depends upon the amount of play in joints 37. Usually there is approximately ⅛" of play per joint 37 so that for a pile 65 which comprises 5 or 6 extension sections 36 one would expect shaft 32 to collapse by approximately ⅝" to ¾" when it is compressed after placement. The amount of collapse of shaft 32 is preferably measured to verify proper placement of pile 65.

After pile 65 has been placed then it may be attached to a foundation or other structure in a manner similar to the way that prior art helical piers 20 are attached to foundations, as discussed above.

Figure 11:
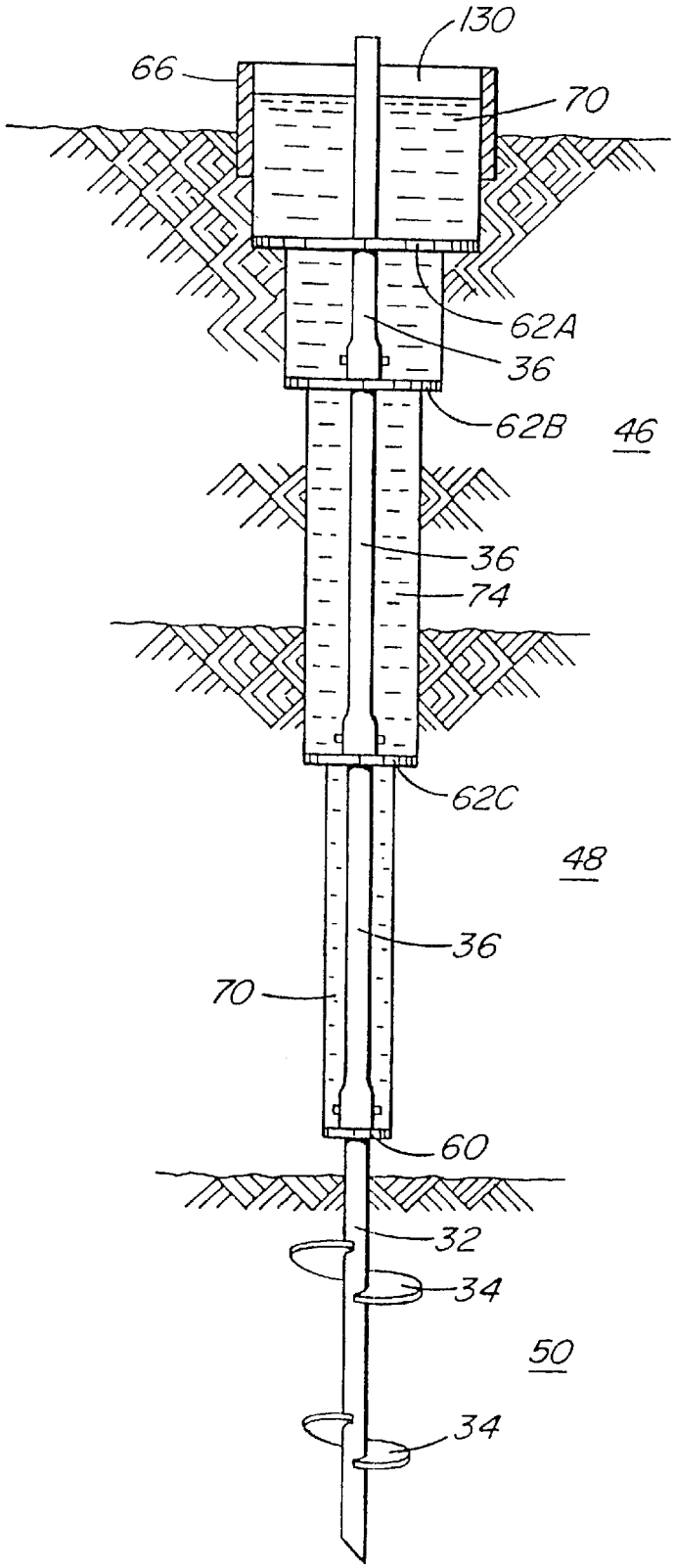
FIG. 11 illustrates the method of the invention being used to make a stepped pile.

Stepped piles generally have greater load bearing capacities than piles having a constant outer diameter. This invention provides a convenient and relatively inexpensive way to create a stepped pile. As shown in FIG. 11, a series of additional soil displacing members, such as disks 62, may increase in diameter in steps along the length of shaft 32. Each larger diameter disk 62 increases the diameter of the portion of cylindrical region 74 that it is pulled through. After the pile has been formed, the largest diameter disks 62A are nearest the surface of the ground, the smallest diameter disks 62C are deepest in the ground and intermediate diameter discs 62B lie along shaft 32 between large discs 62A and smaller discs 62C. As shown in FIG. 11, the result is a pile 130 having a stepped diameter. The largest diameter sections of pile 130 are in the softer layers of soil 46 and 48 nearest the surface. For example, disk 60 and those of disks 62 in the lowermost 10 to 20 feet of a 40 to 50 foot pile 130 could be in the range of about 6 inches to 8 inches in diameter, the disks 62 in the next 10 feet or so could be about 10 inches in diameter, the disks 62 in the next 10 feet or so could be about 14 inches in diameter and the terminal 10 feet or so of the pile could have disks 62 of about 18 inches in diameter.

In some cases a stepped pile 130 will be installed in a place where the topmost layers 46 of soil are very soft. In such cases, additional support may be provided for the uppermost portions of pile 130 by making the uppermost disk or disks 62 significantly larger than disk 60. When screw 34 is in a deeper denser layer 50 of harder soil then it can pull a relatively large disk 62 downwardly through an overlying layer 46 of much softer soil. If surface layers 46 and/or 46 and 48 are extremely soft then one or more of disks 62 closest the surface may be even larger in diameter than screw 34. This is possible when screw 34 has enough purchase in denser layer 50 to pull a larger diameter disk 62 (or other soil displacing member) down through softer layer 46. In cases where the upper layers of soil are extremely soft it is often desirable to have the uppermost sections of the pile encased in a sleeve made, for example, from a section of steel pipe. This can be accomplished as described below with reference to FIG. 7.

In prior art driven piles can be difficult to predict where the pile will "bottom out" and it is therefore complicated to design a pile so that the portion of the pile in the topmost layers of soil is, for example, thicker than other portions of the pile. With a pile 65 made according to this invention it is possible to reverse the direction of rotation of screw 34 after screw 34 "bottoms out" to bring one or more of the topmost disks 62 to the surface. The removed disks can then be replaced with larger disks 62 and screw 34 can be screwed back into the ground to produce a pile 65 in which the surface portions of the pile have a large diameter. By contrast it is very difficult to pull up a standard driven pile after the pile has been hammered into the ground.

Many variations to the invention are possible without departing from the scope thereof. For example, as described above, soil displacement means for use with the invention may have many shapes, sizes and thicknesses. Screw 34 need not be a helical screw exactly as shown in the prior art but may have other forms. What is particularly important is that screw 34 is capable of drawing a soil displacement member, for example a disk or flange on shaft 32, through the soil as screw 34 is turned.

Figure 6:
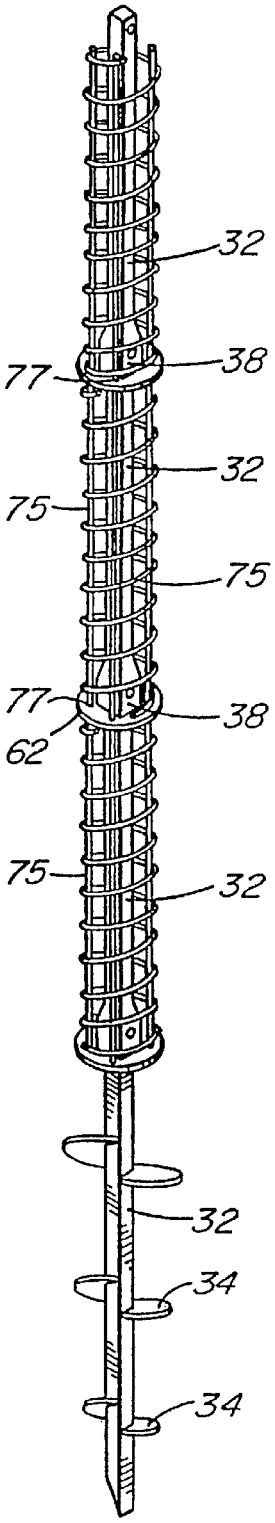
FIG. 6 is a perspective view of a pile made according to the invention reinforced with additional length of reinforcing material.

As shown in FIG. 6, it is possible to reinforce a pile 65 created according to the invention with lengths of reinforcing material 75, such as steel reinforcing bar, which extend through cylindrical region 74. In many applications, reinforcing material 75 may conveniently be 10 to 15 millimeters in diameter although, for some jobs, it may be larger or smaller. For use with lengths of reinforcing material 75 it is preferable that disks 60, 62 have apertures in them through which lengths of reinforcing material 75 can be passed.

Figure 5:
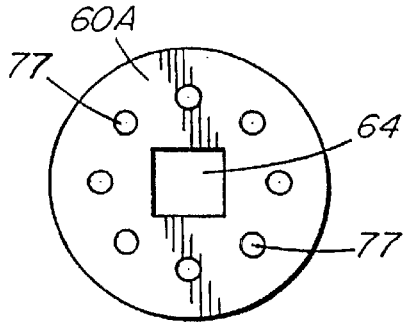
FIG. 5 is a top plan view of an alternative disk for practising the invention.

FIG. 5 shows an alternative disk 60A which has in it a number of apertures 77 for receiving the ends of length of reinforcing material 75. Lengths of reinforcing material 75 are inserted into apertures 77 as disks 60A are drawn down into cylindrical region 74. Each length of reinforcing material 75 extends through an aperture 77 in a disk 60A. Lengths of reinforcing material are made to overlap to meet applicable engineering standards. Apertures 77 hold reinforcing material 75 in place. Lengths of reinforcing material 75 may optionally be welded to disks 60A or 60, 62. Lengths of wire and/or stirrup reinforcements may be used to tie reinforcing material 75 in place during placement and until grout 70 sets.

As shown in FIG. 6, pile 65 may be further reinforced by wrapping one or more additional lengths of reinforcing material 75 around shaft 32 in a spiral inside cylindrical region 74. This is conveniently be done while pile 65 is being installed. A length of reinforcing material 75 can simply be attached to the pile and allowed to wind around the pile as the pile is turned and pulled down into the ground.

Figure 7:
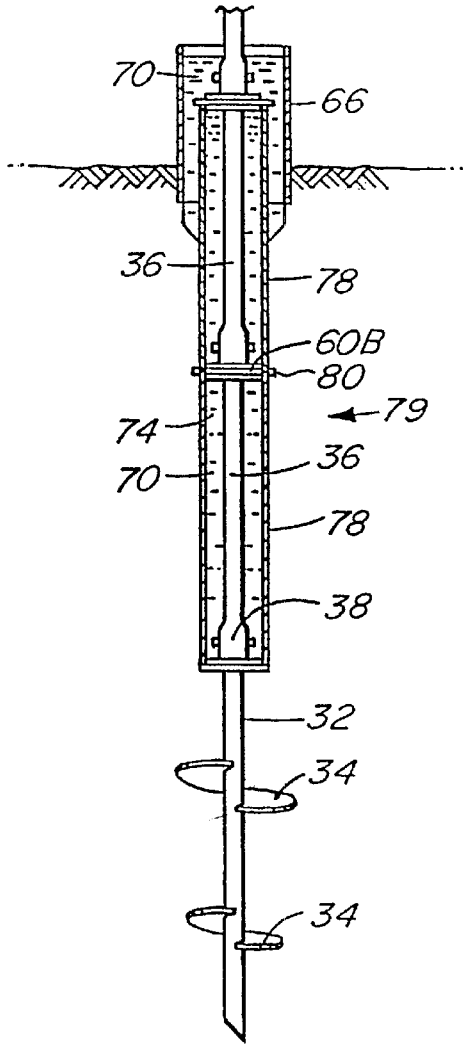
FIG. 7 illustrates the method of the invention being used to manufacture a cased pile.
Figure 8A:
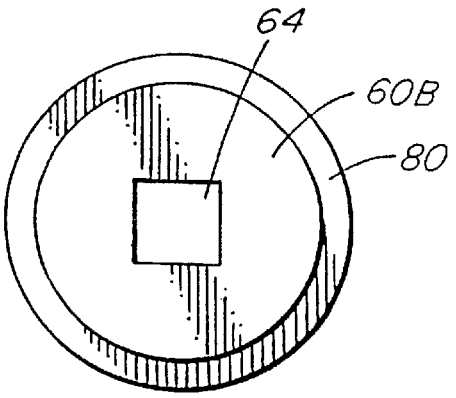
FIGS. 8A and 8B are respectively a top plan view and a side elevational view of a plate for use with the method of the invention for making a cased pile.
Figure 8B:
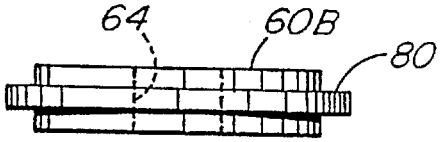

As shown in FIGS. 7 and 8, the method of the invention may also be used for making a cased pile 79 which extends inside a tubular casing 78. Where it is desired to make a cased pile 79 it is preferable that disks 60B as shown in FIGS. 8A and 8B are used. Disks 60B have a flange 80 projecting around their perimeter. Flange 80 is slightly larger in diameter than the exterior diameter of casing 78. The other portions of disks 60B are slightly smaller in diameter than the inner diameter of casing 78. The end of a length of casing 78 is held in contact with flange 80 on disk 60B as disk 60B is pulled into the ground. Casing 78 is dropped into the ground behind disk 60B. Disk 60B keeps casing 78 centered around shaft 32. A separate length of casing 78 is preferably used for each extension section 36 of shaft 32. Casing 78 may comprise, for example, a section of pipe, such as PVC pipe. Casing 78 may be used, for example, where the soil has voids in it into which fluid grout 70 would otherwise escape.

Figure 9:
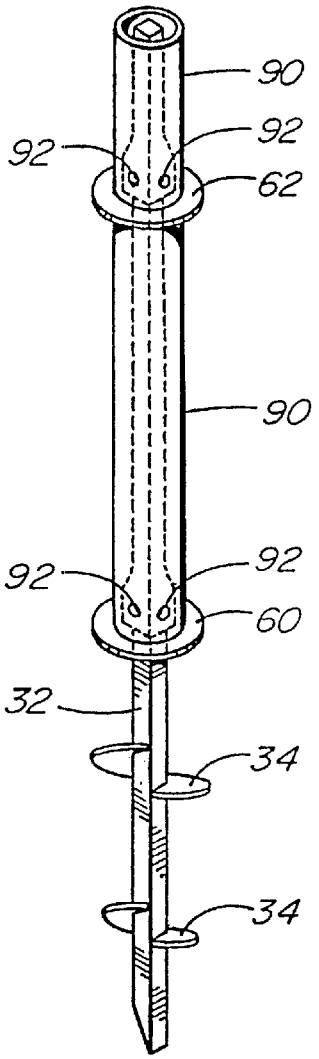
FIG. 9 is a section through an alternative embodiment of the apparatus for practising the invention wherein grout may be introduced through a channel in a central shaft.

While the methods described above have introduced fluid grout 70 into cylindrical region 74 by feeding grout 70 from a grout bath under the action of gravity, grout 70 may also be introduced into cylindrical region 74 in other ways. For example, as shown in FIG. 9, shaft 32 may have a central tubular passage 90 and at least one, and preferably a number of, apertures 92 extending from tubular passage 90 into cylindrical region 74. Fluid grout 70 may then be pumped downwardly through tubular passage 90 and into cylindrical region 74 through apertures 92 either after screw 34 has been screwed to the desired depth or at a point during the installation of screw 34. In the further alternative, a pipe for pumping fluid grout into cylindrical region 74 may run alongside shaft 32 through suitable apertures in plates 62.

The methods described above can produce a pile which is encased in grout above the level of disk 60. However, screw 34 may remain vulnerable to attack by corrosive agents in the soil in which it is embedded. Over time such corrosion could reduce the capacity of the pile. The methods of this invention may be extended to encase screw 34 a suitable grout or another suitable protective medium. The objective is to form a protective ball of solidified grout around at least the root portion 104 of screw 34. The solidified grout both protects screw 34 from attack by corrosive soils and reinforces screw 34 against buckling under load.

Figure 12:
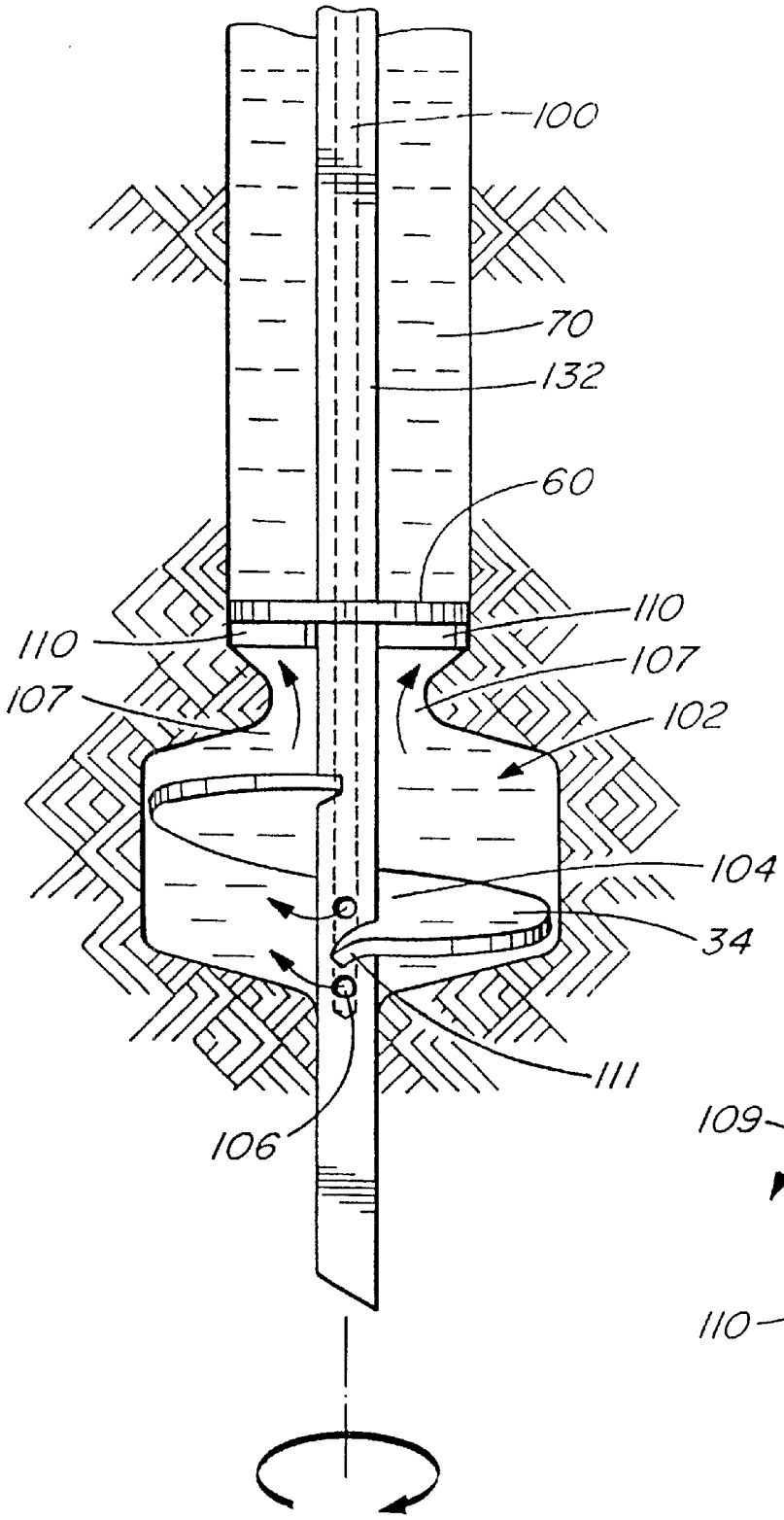
FIG. 12 is an elevational view of apparatus according to an embodiment of the invention which permits a screw to be encased in a layer of grout.
Figure 14:
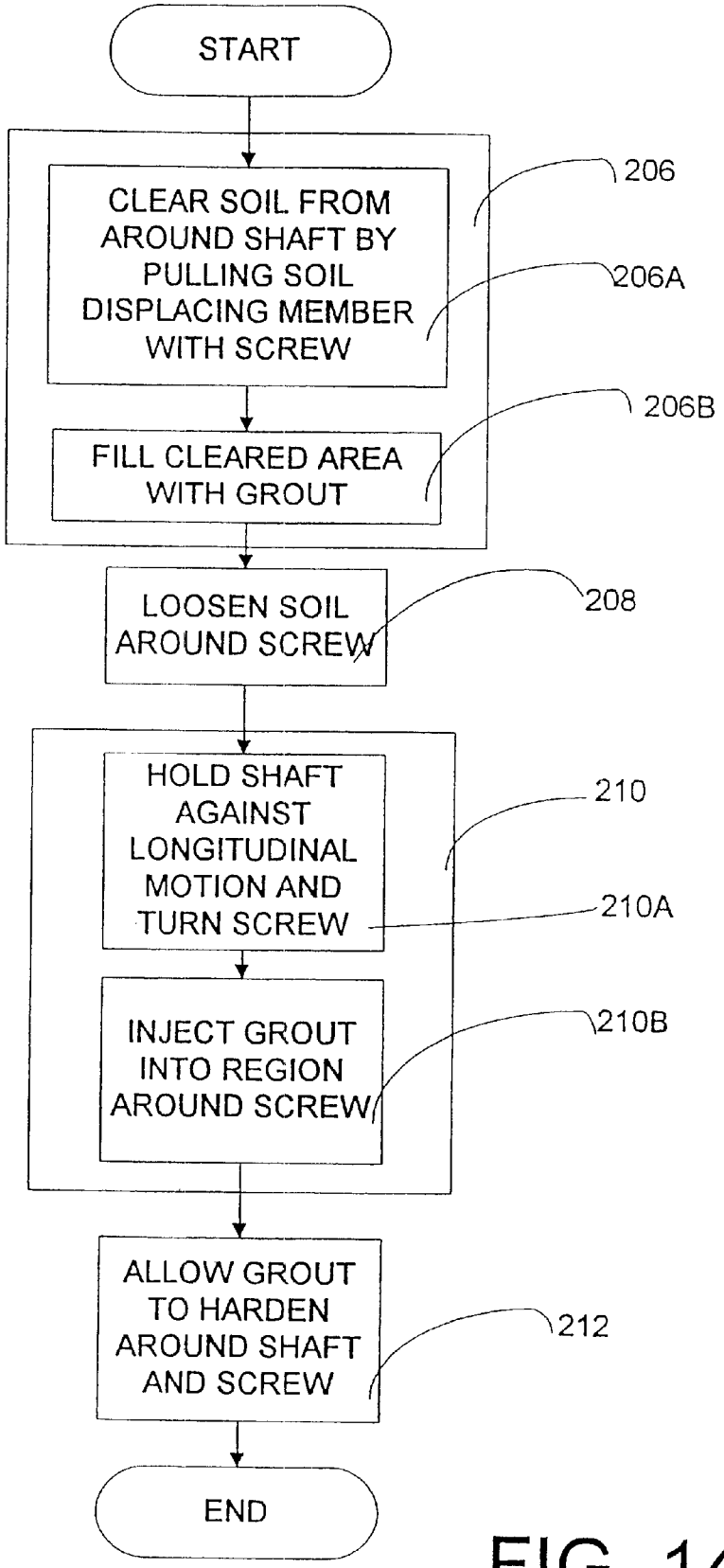
FIG. 14 is a flow chart illustrating steps in a method according to one embodiment of the invention.
Figure 15:
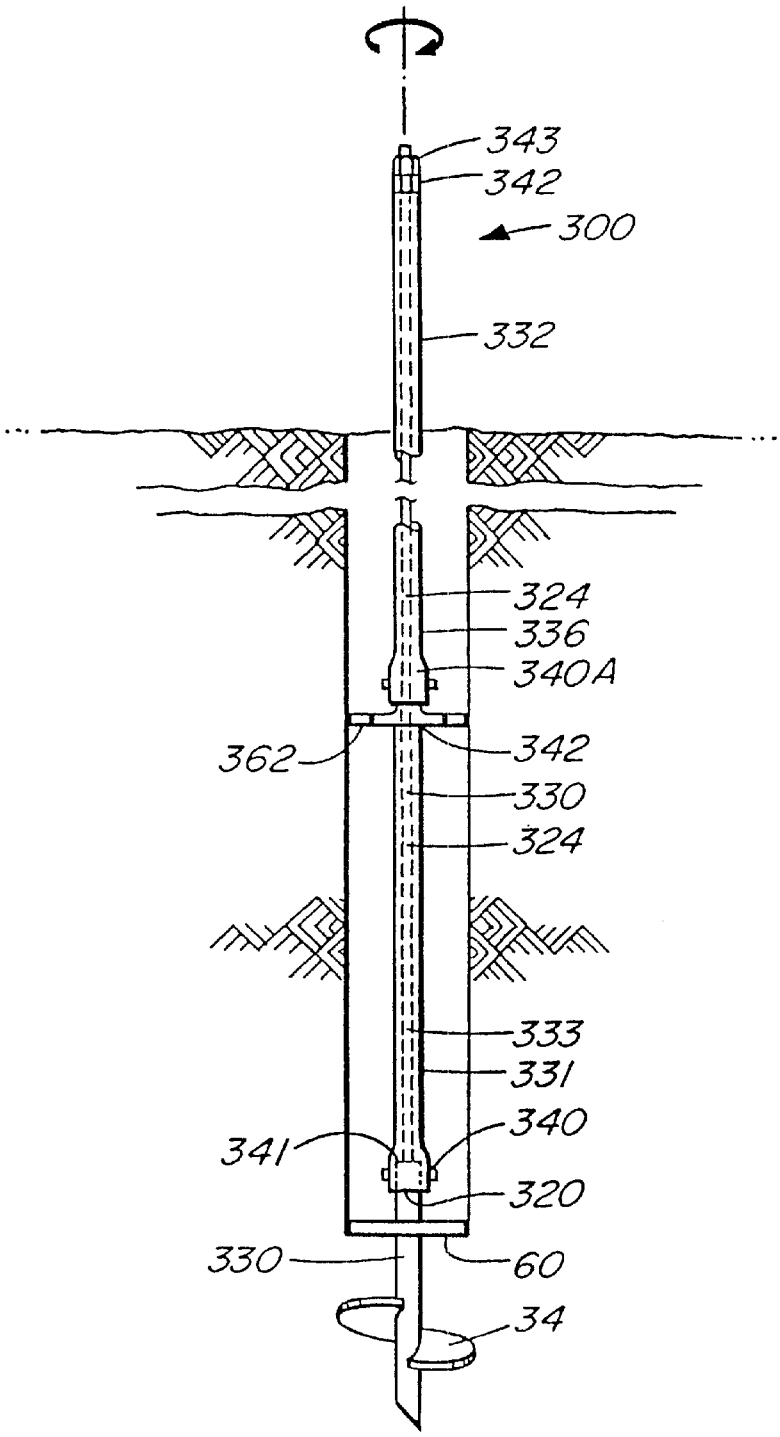
FIG. 15 is a schematic elevational view of apparatus according to an alternative embodiment of the invention.

As shown in FIG. 12, shaft 132 has a central conduit 100 extending longitudinally through to one or more apertures 106 in the vicinity of root 104 of screw 34. Shaft 132 may be inserted into the ground as described above (FIG. 14, step 206). After screw 34 has been screwed to its desired depth, as described above, grout or another suitable medium may be forced through conduit 100 under high pressure (step 210B). The grout is delivered into a region 102 surrounding screw 34 through apertures 106 until it coats screw 34. It is generally not sufficient to simply pump pressurized grout into region 102 because it will generally not be possible to introduce grout into region 102 in a way such that the flowing grout will reliably displace corrosive soils from contact with screw 34.

Screw 34 is operated to remove soil surrounding screw 34 from area 102 (step 210A) either during or just before the introduction of grout into region 102. This may be done, for example, by preventing shaft 132 from moving vertically while turning screw 34. Screw 34 then acts like an auger and displaces soil from region 102 either upwardly or downwardly depending upon the direction in which screw 34 is turned. Most preferably, screw 34 is turned in a sense which would move screw 34 deeper into the soil while shaft 132 is prevented from moving deeper. The soil in region 102 is thus displaced toward the lowermost soil displacing member (e.g. disk 60).

Shaft 132 may be prevented from moving deeper by coupling its upper end with a thrust bearing to a large plate or the like lying on the surface of the ground. The plate is too large to be pulled downwardly by screw 34. The thrust bearing allows shaft 32 to turn relative to the large plate.

Preferably, the soil in region 102 is loosened (step 208) before step 210 by repeatedly turning screw 34 through several turns in alternating directions of rotation.

Figure 13:
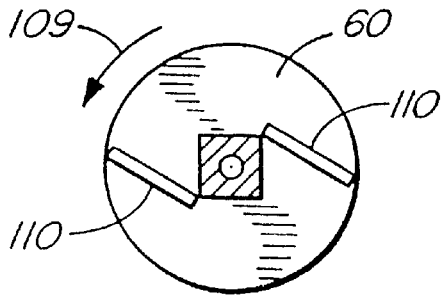
FIG. 13 shows a soil displacement member equipped with paddles.

As shown in FIG. 12, during step 210 grout flows upwardly from apertures 106, as indicated by arrows 107 and helps to carry soil out of region 102. The flowing grout is deflected outwardly at disk 60. Preferably disk 60 is not more than about 8 inches above screw 34. Most preferably disk 60 is not more than about 4 to 6 inches above screw 34. Preferably disk 60 has paddles 110 oriented as shown in FIG. 13 to drive soil and grout outwardly when disk 60 turns in the direction indicated by arrow 109. The result is that the root portion 104 of screw 34 and the lower portions of shaft 32 become encased in a ball of grout.

If screw 34 is embedded in a layer of non-cohesive soil, such as sand, then it may be possible to perform step 210 in two separate steps, first turning screw 34 to remove soil from region 102 (step 210A) and subsequently pumping grout into region 102 (step 210B). Most preferably, however, grout is introduced through apertures 106 at the same time as screw 34 is turned. The turning screw 34 both removes soil from region 102 and distributes grout through region 102.

While it is not preferred, step 210 may be performed by turning screw 34 in a sense that would tend to cause screw 34 to move upwardly. Shaft 132 may be prevented from moving upwardly by bearing down on its upper end with a heavy machine, such as a backhoe. Screw 34 then tends to push soil downwardly out of region 102. In this case, apertures 106 would be on shaft 132 near the upper end of screw 34.

Figure 20A:
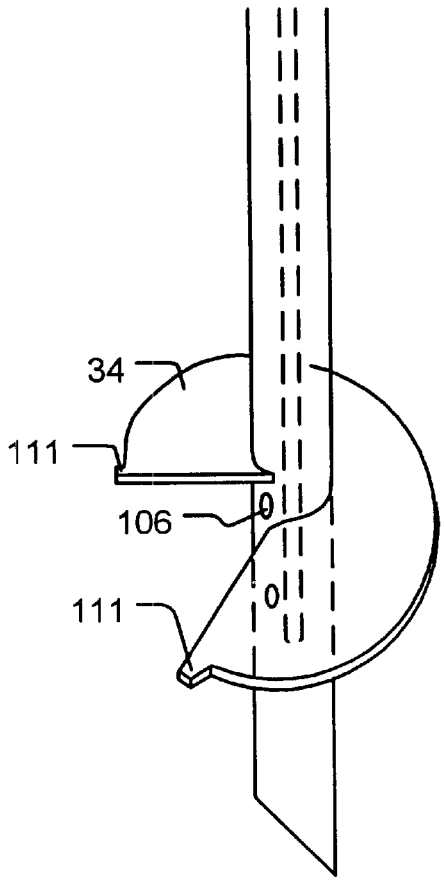
FIG. 20A is a schematic elevational view of a screw having radially outwardly extending tabs; and, FIG. 20B is a schematic elevational view of a screw having a notched peripheral edge.
Figure 20B:
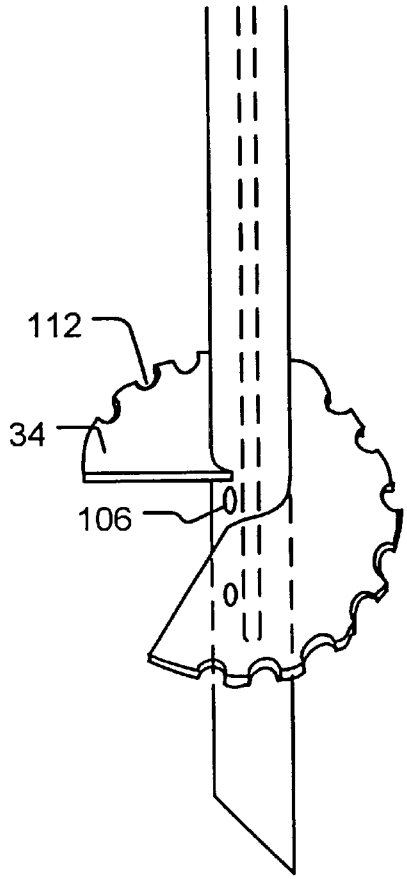

Especially where screw 34 is a helix, screw 34 is preferably modified so that soil is cleared from a volume that is slightly larger in diameter than the bearing surfaces of screw 34 during the steps described above. For example, as shown in FIG. 20A, short radially outwardly projecting tabs 111 may be provided on the leading edge and/or leading and trailing edges of screw 34. During step 210 when screw 34 is operated to remove soil from region 102, tabs 111 loosen the soil in a cylindrical shell area around screw 34. When grout is pumped into region 102 the grout can flow into the cylindrical shell area and around the outside edges of screw 34 through the cylindrical shell area. The grout can thereby form a protective ball around the edge surfaces of screw 34. The outer edge of screw 34 may be serrated, as shown in FIG. 20B, by providing notches 112 around the peripheral edge of screw 34 to achieve a similar effect.

Finally, (step 212) the grout is allowed to harden around screw 34 and shaft 32. The hardened grout around screw 34 both protects screw 34 from corrosion and reinforces screw 34 against buckling.

The torque which shaft 32 must transmit to screw 34 is increased if the soil through which screw 34 is being screwed is very hard or if a soil displacement member is being drawn through a hard layer of soil. In some cases shaft 32 must be made significantly stronger than would be otherwise necessary to transmit the necessary torque to screw 34. This could make inserting a pile according to the invention more expensive. FIGS. 15 through 19 illustrate an alternative system 300 according to the invention in which torque is transmitted to screw 34 through a removable driving tool 332. After screw 34 has been screwed to the desired depth then driving tool 332 may be removed and re-used.

System 300 has a screw 34 and a soil displacing member 60 mounted on a lead section 330. A shaft 333 extends upwardly from a head end 320 of lead section 330. Shaft 333 does not need to be strong enough to transmit the torque necessary to screw screw 34 to its desired location.

Driving tool 332 has a central bore 328. Driving tool 332 is placed over shaft 333 with shaft 333 passing through bore 328. A socket 340 on the lower end of driving tool 332 engages a head 341 on head end 320 of lead section 330. Head 341 and socket 340 may, for example, be square in section. A fastener 343 at the upper end of shaft 333 holds driving tool 332 in engagement with lead section 330. Rotating driving tool 332 about its axis turns lead section 330. The torque for turning screw 34 is delivered primarily through driving tool 332 and not through shaft 333. Shaft 333 could have a central bore connecting to a bore in lead section 330 to allow the methods described above with reference to FIG. 12 to be used to encase screw 34 in grout.

Driving tool 332 preferably comprises a lower section 331 having a socket 340 adapted to engage lead section 330 and a number of intermediate sections 336 that may be added to increase the overall length of driving tool 332 as screw 34 enters the ground. Each section 336 has a socket 340A at one end and a head 342 at its other end. The head 342 of the uppermost section may be engaged by a rotary tool to turn driving tool 332 about its axis and to thereby turn screw 34. Shaft 333 may conveniently comprise a series of screw-together sections 324 each a few feet long. Fastener 343 may be removed to permit the addition of more sections 324 and 336 and then replaced to continue the installation. Sockets 340A and heads 342 may be the same as or different from socket 340 and head 341 respectively.

After screw 34 has been installed at the correct depth then fastener 343 may be released and driving tool 332 may be removed from around shaft 333 while leaving shaft 333 in place. Driving tool 332 may then be rinsed to remove any fluid grout adhering to it and reused.

Additional soil displacement members 362 may optionally be mounted to driving tool 332. Additional soil displacement members 362 should be attached to driving tool 332 in such a manner that they do not remain attached to driving tool 332 but fall away as driving tool 332 is withdrawn from around shaft 333. FIGS. 16 through 19 show one possible way to mount additional soil displacement members 362 on driving tool 332.

Figure 16:
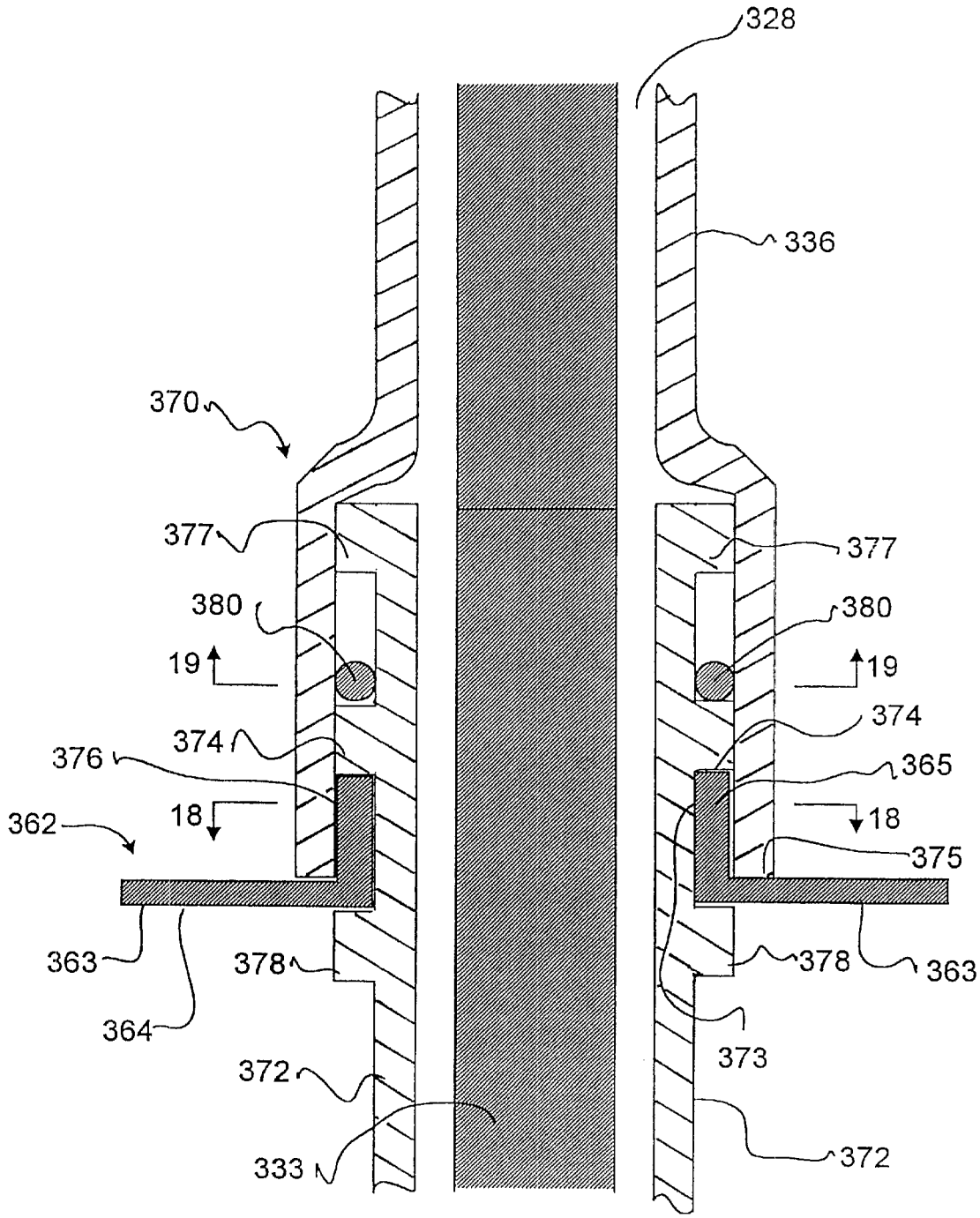
FIG. 16 is a partial elevational section through a joint thereof in a first position.

As shown in FIG. 16, each section 336 of driving tool 332 has a socket 370 which slidably receives the head end 372 of the next section of driving tool 332. Head end 372 comprises abutments 374 which project outwardly from an adjoining portion 373 of head end 372.

Figure 17:
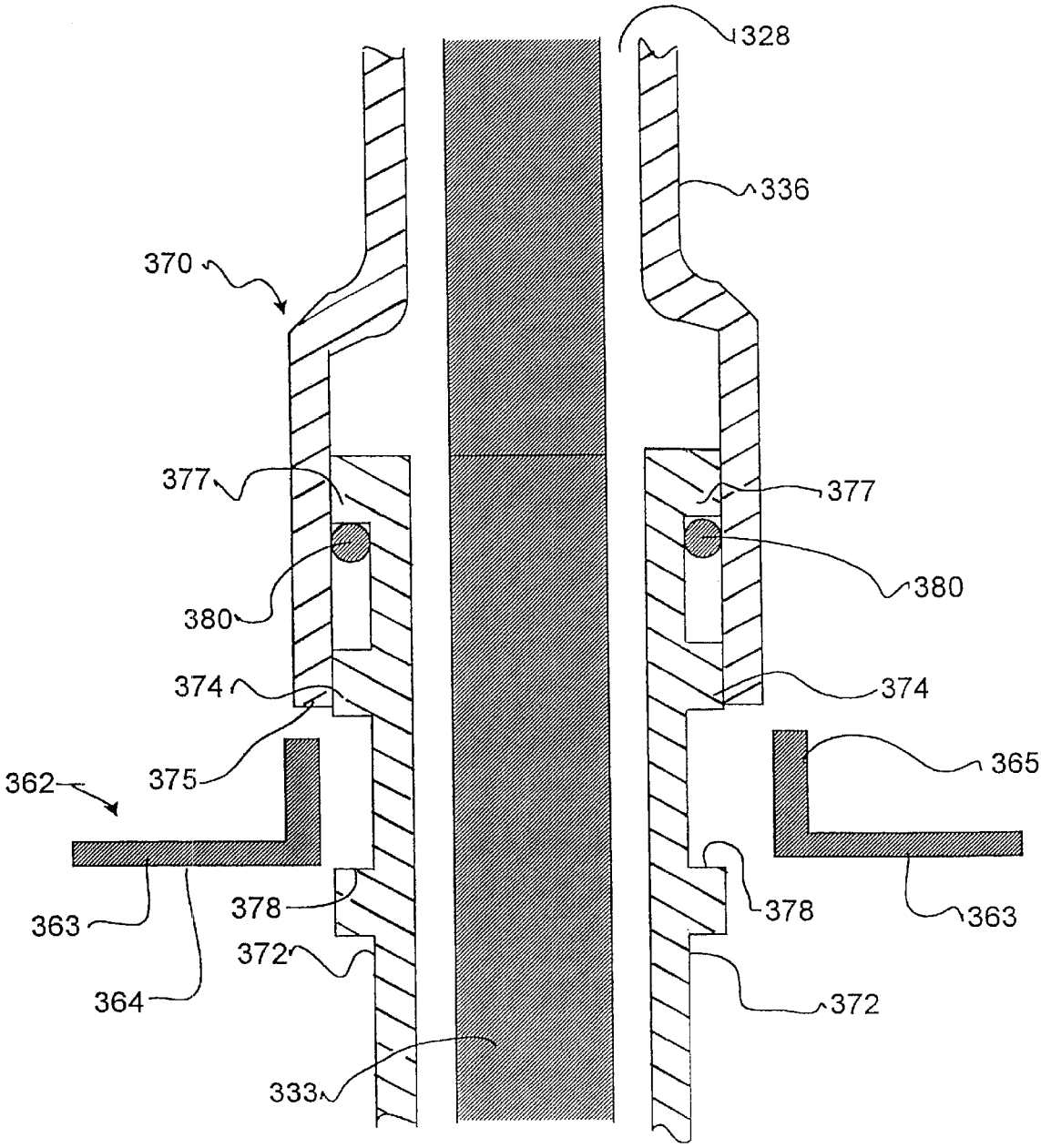
FIG. 17 is a partial elevational section through a joint thereof in a second position.
Figure 18:
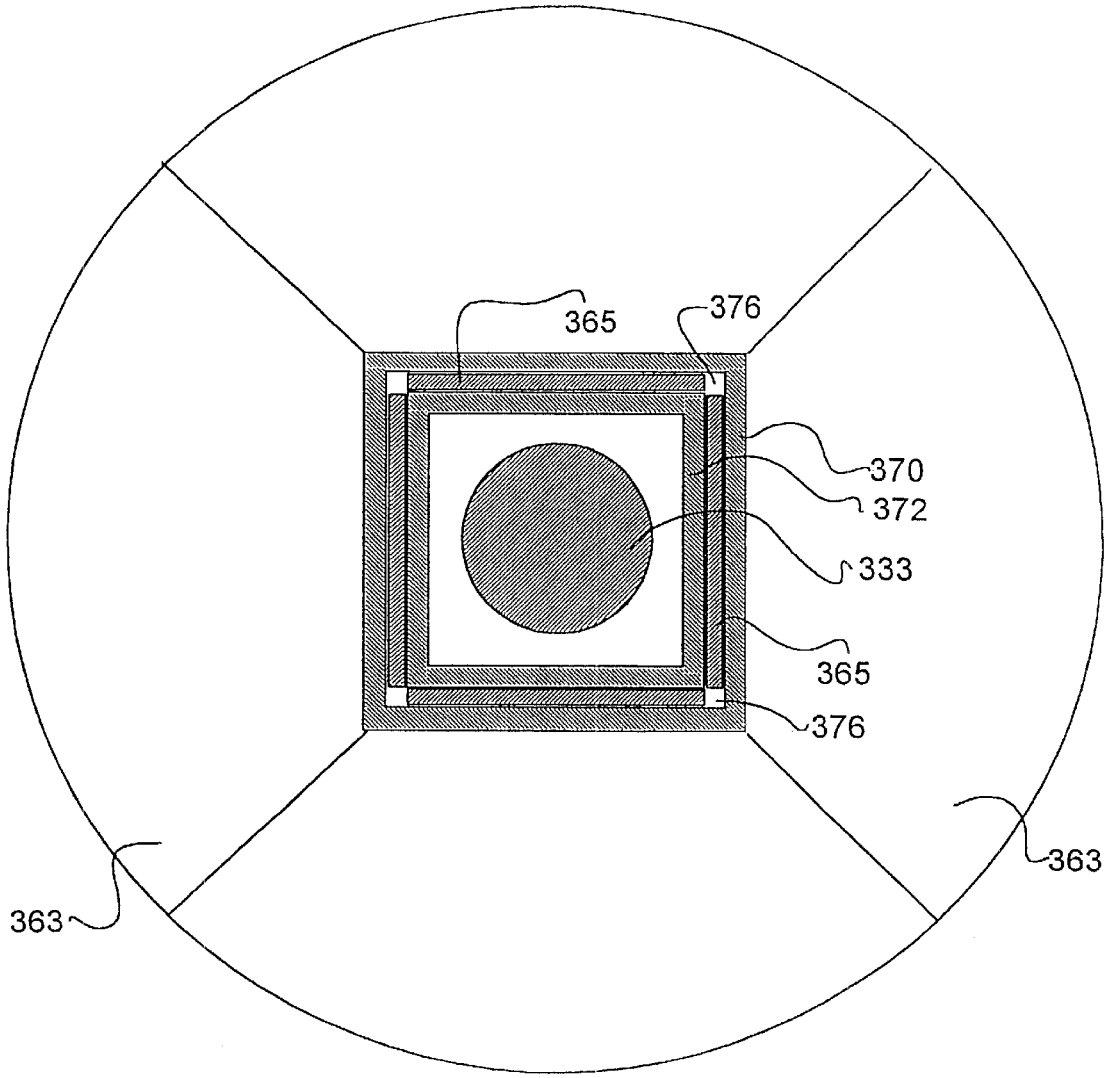
FIG. 18 is a transverse section on the line 18—18 of FIG. 16.
Figure 19:
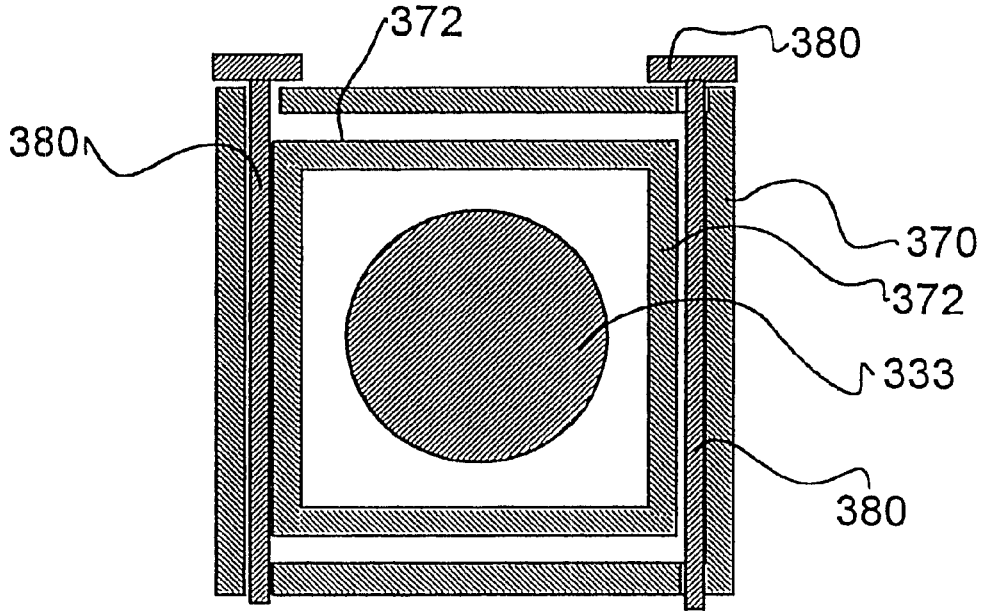
FIG. 19 is a transverse section along the line 19—19 of FIG. 16.

The outer faces of abutments 374 engage with the inner faces of socket 370 so that head end 372 is prevented from turning in socket 370. Sockets 370 are coupled to head portions 372 by fastening members which, in the drawings, are illustrated as pins or bolts 380. Fastening members 380 permit socket 370 to slide relative to head portion 372 between a first position (as shown in FIG. 16) and a second position (as shown in FIG. 17) without disengaging from head portion 372.

In the first position, as shown in FIG. 16, socket 370 fully receives head end 372 and the lowermost edge 375 of socket 370 extends past abutments 374 to define a number of recesses 376 around the circumference of lowermost edge 375.

Soil displacement member 362 comprises a number of segments 363. Each segment 363 has an outwardly projecting portion 364 which serves to displace soil, as described above in respect of soil displacement disks 62, and a tab 365 which is received in one of recesses 376. Projections 378, which extend from head end 372 retain segments 363 with their tabs 365 engaged in recesses 376. Segments 363 collectively provide substantially the same function of other soil displacement members, such as the disks 62 which are described above. While screw 34 is being driven into the ground, fastener 343 holds each socket 370 in its first position. As screw 34 is being driven into the ground the forces on segments 363 tend to hold tabs 365 engaged in recesses 376.

When screw 34 has been installed to the correct depth then fastener 343 is removed and the upper end of driving tool 332 is pulled axially away from screw 34. As this happens then each of sockets 370 is pulled into its second position, as shown in FIG. 17. In the second position, lower edge 375 is even with, or above, abutments 374 and tabs 365 are no longer coupled to driving tool 332. Segments 363 can therefore fall away. Pins 380 prevent sockets 370 from separating from head portions 372 by bearing against an upper set of abutments 377 which project from head end 372. Shaft 333 remains connected to lead section 330.

Those skilled in the art will realize that sockets 370 could be coupled to head portions 372 in many ways which allows limited motion between a first position in which segments 363 are retained and a second position in which segments 363 are released.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

We claim:

1. A screw pier for making a grout encased stepped pile, said pier comprising:

(a) an elongated shaft having first and second ends;

(b) a screw adjacent said first end of said shaft;

(c) a plurality of soil displacing members at spaced apart locations along said shaft, a first one of said soil displacing members located near said screw and having a diameter smaller than a diameter of said screw, other ones of said soil displacing members having diameters larger than said first one of said soil displacing members, said soil displacing members nearer to said second end of said shaft having larger diameters than said soil displacing members farther from said second end of said shaft.

2. The screw pier of claim 1 wherein said soil displacing members comprise flanges projecting radially from said shaft.

3. The screw pier of claim 1 wherein said soil displacing members comprise generally planar disks mounted on and oriented generally perpendicularly to said shaft.

4. The screw pier of claim 1 comprising a channel capable of carrying a fluid grout and extending through said shaft, said channel communicating with one or more apertures extending through a wall of said shaft adjacent said screw.

5. The screw pier of claim 4 wherein said screw comprises at least one tab projecting radially outwardly from a peripheral edge of said screw.

6. The screw pier of claim 4 wherein a peripheral edge of said screw is notched.

7. The screw pier of claim 1 wherein said shaft comprises a plurality of sections connected by joints and said plurality of soil displacing members are each mounted on one of said sections between a pair of said joints.

8. The screw pier of claim 1 wherein at least one of the soil displacing members has a diameter greater than the diameter of the screw.

9. A screw pier for making a grout encased pile, said screw pier comprising:

(a) a lead section comprising a screw, a head and a soil displacing member between the screw and the head;

(b) an elongated shaft having a first end coupled to the lead section head;

(c) an elongated drive tool having a socket in driving engagement with the lead section head, the elongated shaft extending through a central bore in the drive tool.

10. The screw pier of claim 9 comprising a fastener at a second end of the elongated shaft, the fastener holding the drive tool socket engaged with the lead section head.

11. The screw pier of claim 9 further comprising one or more additional soil displacing members detachably affixed to an outer surface of the drive tool.

12. The screw pier of claim 11 wherein said additional soil displacing members each comprise a plurality of sectors each sector comprising an outwardly projecting portion and a tab portion.

13. The screw pier of claim 11 wherein the drive tool comprises two or more sections connected by one or more joints and each joint comprises a head end of one drive tool section received in a socket on one end of another drive tool section, the socket movable longitudinally relative to the head end between first and second positions wherein, when said socket is in said first position, an edge of said socket projects past an abutment on said head end to provide a recess facing said screw, said recess capable of receiving tab portions of said sectors and, when said socket is in said second position, said edge of said socket is retracted, thereby releasing said tab portions of said sectors.

14. A screw pier for making a grout encased stepped pile, the screw pier comprising:

an elongated shaft having first and second ends;

a screw adjacent the first end of the shaft;

at least two soil displacing members spaced apart along the shaft, a first one of the soil displacing members located closer to the screw than a second one of the soil displacing members, the first one of the soil displacing members adapted to clear soil from a cylindrical region surrounding the shaft when drawn through the soil by rotation of the screw, the second one of the soil displacing members adapted to increase a diameter of the cylindrical region when drawn through the soil by rotation of the screw.

15. The screw pier of claim 14 wherein the soil displacing members comprise discs projecting radially from the shaft.

16. The screw pier of claim 15 wherein the first one of the soil displacing members comprises a disc having a diameter smaller than a diameter of the screw.

17. The screw pier of claim 15 wherein the first soil displacing member has a diameter in the range of 6 inches to 8 inches.

18. The screw pier of claim 14 wherein the first one of the soil displacement members is located within 8 inches of the screw.

* * * * *